US008733580B1

(12) United States Patent
Schall, Jr.

(10) Patent No.: US 8,733,580 B1
(45) Date of Patent: May 27, 2014

(54) APPARATUS FOR USE WITH A LIQUID COATING CONTAINER

(76) Inventor: Stanley L. Schall, Jr., Willamsport, PA (US)

( * ) Notice: Subject to any disclaimer, the term of this patent is extended or adjusted under 35 U.S.C. 154(b) by 179 days.

(21) Appl. No.: 13/036,302

(22) Filed: Feb. 28, 2011

Related U.S. Application Data

(63) Continuation of application No. 11/165,117, filed on Jun. 24, 2005, now abandoned, which is a continuation-in-part of application No. 11/124,114, filed on May 9, 2005, now abandoned, which is a continuation-in-part of application No. 10/313,289, filed on Dec. 6, 2002, now abandoned.

(60) Provisional application No. 60/336,713, filed on Dec. 7, 2001.

(51) Int. Cl.
*B65D 25/20* (2006.01)

(52) U.S. Cl.
USPC ..... 220/570; 220/571.1; 220/23.91; 220/738; 220/23.89

(58) Field of Classification Search
USPC ..... 220/23.87, 23.89, 738, 737, 570, 630, 220/625, 571.1, 23.91
See application file for complete search history.

(56) References Cited

U.S. PATENT DOCUMENTS

| | | | | |
|---|---|---|---|---|
| 864,556 | A | | 8/1907 | Reiter |
| D110,902 | S | | 8/1938 | Loesch |
| 2,518,214 | A | | 8/1950 | Worthington |
| 2,589,967 | A | | 3/1952 | Sawyer |
| 2,626,737 | A | | 1/1953 | Pitz |
| 2,630,241 | A | | 3/1953 | Schnabel |
| 2,683,579 | A | | 7/1954 | Wallace |
| 2,781,148 | A | | 2/1957 | Reddle |
| 2,997,199 | A | | 8/1961 | Reachi |
| 3,731,658 | A | | 5/1973 | Livermore et al. |
| 3,842,981 | A | * | 10/1974 | Lambert ..... 211/74 |
| 3,858,810 | A | | 1/1975 | Seeley et al. |
| 3,951,079 | A | | 4/1976 | Tolleson |
| 4,101,046 | A | | 7/1978 | Puntillo |
| 4,127,211 | A | | 11/1978 | Zerbey |
| 4,819,843 | A | * | 4/1989 | Nakayama ..... 224/553 |
| 4,852,759 | A | | 8/1989 | Williams et al. |
| 4,886,016 | A | | 12/1989 | Atchley |
| D331,174 | S | * | 11/1992 | Polski ..... D7/701 |
| 5,172,822 | A | | 12/1992 | Defrance |
| 5,413,302 | A | | 5/1995 | Ferster |
| 6,062,418 | A | | 5/2000 | Rathjen |
| 6,164,473 | A | | 12/2000 | Waldrip |
| 6,237,880 | B1 | | 5/2001 | McNutly |
| 6,283,345 | B1 | | 9/2001 | Butschat |
| 6,662,959 | B1 | | 12/2003 | Westerhold |

* cited by examiner

*Primary Examiner* — Stephen Castellano
(74) *Attorney, Agent, or Firm* — Cahn & Samuels, LLP

(57) ABSTRACT

The present invention is directed to a device for holding a container having a base and a wall extending up and in from the base. The base rings the bottom of the wall such that a cavity is formed into which a container is placed. In at least one embodiment, the base includes a trough and in other embodiments the base is an annular member without a trough. In at least one embodiment, the wall of the device includes a conical portion extending from the base up to a cylindrical portion that fits around the container.

17 Claims, 12 Drawing Sheets

APPARATUS FOR USE WITH A LIQUID COATING CONTAINER

This application is a continuation application of U.S. patent application Ser. No. 11/165,117, filed on Jun. 24, 2005 now abandoned, which is a continuation-in-part application of U.S. patent application Ser. No. 11/124,114, filed on May 9, 2005 now abandoned, which is a continuation-in-part application of U.S. patent application Ser. No. 10/313,289, filed on Dec. 6, 2002 now abandoned, which claims the benefit of U.S. Provisional Application Ser. No. 60/336,713, filed on Dec. 7, 2001. Each of these patent applications is hereby incorporated by reference.

I. FIELD OF INVENTION

This invention relates, in general, to assisting an individual in the application of different liquid coatings from containers such as paint cans or tar containers. More particularly, this invention is a device which surrounds and supports liquid coating containers, and assists in the use of brushes and/or other applicable tools for applying a liquid coating.

II. BACKGROUND OF THE INVENTION

There are a variety of containers available for storing and transporting liquid for creating a coating such as paints, varnishes, adhesives, and tars that typically consist of a can (or other containers) and a lid. There are a variety of problems that arise when applying a liquid coating from a container(s) from—what to do with the lid, to how to locate the container to minimize spills and messes, and to what to do with the tool being used to apply the coating during work breaks or movement about the worksite.

Prior to applying the coating by the user, the lid is removed from the can and typically left in the area where it was removed. Typically, the lid is left liquid side face up on the floor or ground to be stepped on; dry and become attached to newspapers, drop cloths, etc.; gather dirt (particularly outside), dust, pollen, and other airborne particles that then will wind up in the container when the lid is re-secured; misplaced/lost; similar color coatings made of different liquid coating (e.g., latex and enamel paints) being put on the wrong container to contaminate the respective containers particularly when there are multiple workers; and it can be difficult to pick-up and re-secure to the container. The lid is even more likely to be left somewhere away from the container when the worker needs to move around a worksite to apply the coatings or climb scaffolding or ladders.

If the lid is placed faced down, it may become attached to the surface where it is resting. If it is placed face up, then it will be an attractant for dust, debris and other things floating in the air. Under either scenario, the lid will need to be cleaned prior to being put back on the can if the can still has liquid coating that will be stored to avoid contamination of the liquid coating.

When a worker is on an extension ladder, the container is typically secured by a hook connected to the handle or when on a folding ladder, it is typically placed on the top or a flip out shelf. Under either scenario, there are problems such as the container being prone to being inadvertently knocked down and spilled, thus creating a mess below and on any other surfaces in the way or nearby including the worker. When the container is on a hook, the worker needs to reach around the ladder to dip the application tool into the container, which can be awkward and inefficient while also leading to splattering of the liquid coating if the worker is not careful.

The traditional use of liquid coatings has been complicated due to the potential of containers to tip over during use. This occurs both on flat surfaces, and especially on angled surfaces such as an angled roof. An additional complication while operating on an angled roof is that the container is susceptible because of gravity to sliding down and off the roof potentially onto the ground creating a mess.

Another problem that occurs with containers is that when the container is full, it cannot be placed on an incline surface without some of the contents spilling over the edge.

Another problem is having a place to temporarily store a brush (or other application tool) so as to not lose any of the available liquid coating within, for example, the bristles (or sponge head), and so as to not allow the bristles (or sponge head) an opportunity to dry out. Placing the brush on newspaper or some other disposable material will likely result in the brush becoming attached to the newspaper and needing to be separated from the newspaper before starting again after a break.

Another frequent problem is that the container's label will become covered with the liquid coating, and is therefore unidentifiable. This typically occurs during the pouring of the liquid coating from the can and/or when the user wipes the excess liquid coating from the bristles of a brush (or other application tool) onto the can's rim, which can then allow the liquid coating to travel down the exterior of the can and over the label. A related problem is that as the label is covered by the liquid coating, the handle for the container is also likely to be covered, which leads to an additional mess for the worker whose hands will then get covered by any wet liquid coating present on the handle. This becomes an even larger problem if the liquid coating is a tar or an adhesive, because the handle will likely become attached to the container and unusable as a handle.

A variety of current devices that attach to paint cans have problems in staying connected to the paint can and/or providing sufficient improvement in stability to make a difference. Some current devices attach to the paint can around the bottom of the paint can, which results in the can likely becoming jarred loose if the combination is dropped, particularly if dropped at an angle, or inadvertently hit against a structure. If the container comes free, then there will likely be a spill and/or loss of control of any applicator being carried along with the container.

Existing devices that have a non-oval shaped base, such as a square base, are more easily tipped over because of the straight side if tripped over or hit. The existing devices also do not have bases that provide support from the ground (or other working surface) to a sufficient height on the can and do not have base coverage areas that are much larger than the paint cans, which means that next to little additional stability is provided by these devices.

Even when the current devices rest against the ground, the cans are also against the ground, which is not typically an issue unless the surface is cold. When the ground or other surface is cold, the liquid coating is exposed to the colder temperature through thermal transfer via the bottom of the can. As paint and other liquid coatings are cooled, the elasticity and liquidity of the liquid coating decrease, which leads to the available working time being decreased and to the liquid coating not being applied to the desired surface evenly and can lead to an uneven look particularly with paint.

Other devices have been devised to assist in one form or another within the traditional complications of working with a liquid coating container and a brush (or other application tool), and notwithstanding the usefulness of any prior devices, a need still exists for a device which will efficiently and simultaneously rectify multiple complications.

III. SUMMARY OF THE INVENTION

Illustrative, non-limiting embodiments of the present invention overcome the aforementioned and other disadvantages associated with liquid coating containers. Also, the present invention is not required to overcome the disadvantages described above and particular illustrative non-limiting embodiments of the present invention may not overcome any of the problems described above.

Various exemplary embodiments address some or all of the ongoing and recurring problems that occur while working with a liquid coatings container and an application tool for applying liquid coatings.

According to at least one embodiment, a device for holding and supporting a container having a handle and a pair of ears, the device includes a base having an opening passing therethrough larger than the container to be inserted, and a wall extending up and in from the base, the wall including an angled section connected to the base, and a container engaging means for engaging the container. According to at least one embodiment, the device is included as part of a kit, which also includes at least one an attachment having a cover having an opening passing therethrough, a rim encircling a perimeter of the cover, the rim capable of engaging the top of the device, a vertical wall depending from the cover, the vertical wall encircling a perimeter of the opening, and a means for supporting the container.

According to at least one embodiment a device for holding and supporting a container on a support surface, the device includes a base capable of sitting on the support surface, the base including a trough; and a wall extending up and inward from the base, the wall including an angled section connected to and in fluid communication with the trough, and a vertical section connected to the angled section, the vertical section capable of contacting the container; and the base and the wall form a cavity configured to receive the container, and the trough forming a perimeter around the cavity.

According to at least one embodiment, a device for supporting and holding a container having a pair of ears connected by a handle, the device includes a base having a trough and at least two protrusions connected to the trough, and a wall extending up and in from the base, the wall including a angled section connected to and in fluid communication with the trough, a vertical section connected to the angled section, the vertical section including a pair of slots configured to engage the ears of the container, at least one shelf extending from an inside of the vertical section at a location below the slots, at least one handle mount having a plurality of sections with a notch present between each of the sections; and the base and the wall form a cavity configured to receive the container, and the trough forming a perimeter around the cavity.

IV. BRIEF DESCRIPTION OF THE DRAWINGS

The aspects of the present invention will become more readily apparent by describing in detail illustrative, non-limiting embodiments thereof with reference to the accompanying drawings.

The use of cross-hatching within these drawings should not be interpreted as a limitation on the potential materials used for construction of the invention. Like reference numerals in the figures represent and refer to the same element or function.

Figure 9A:
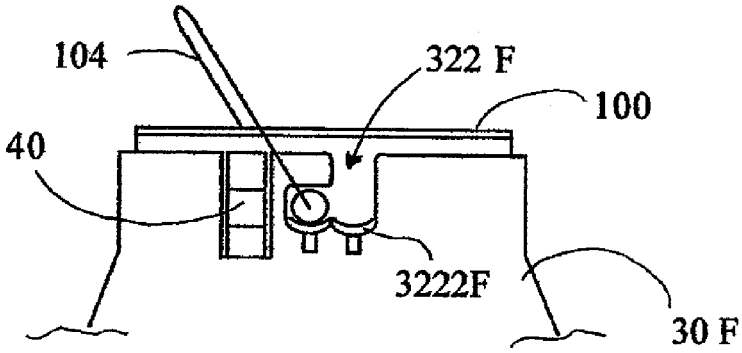
FIGS. 9A-9D illustrates an exemplary embodiment according to the invention.
Figure 9B:
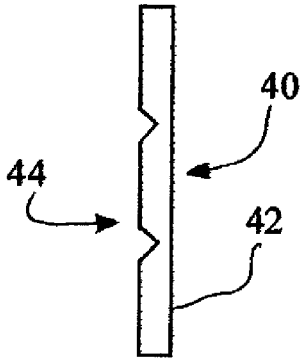
Figure 9C:
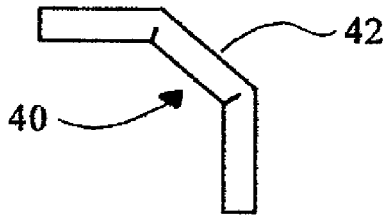
Figure 9D:
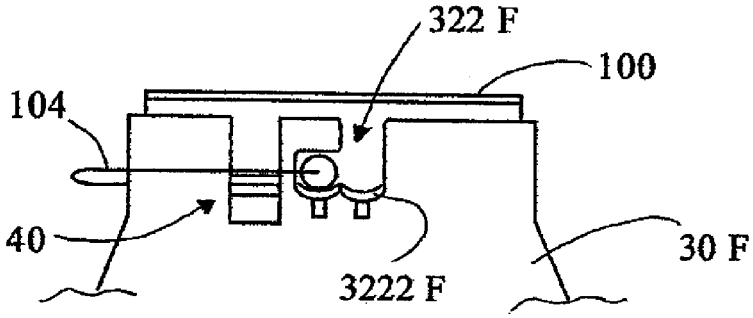
Figure 9E:
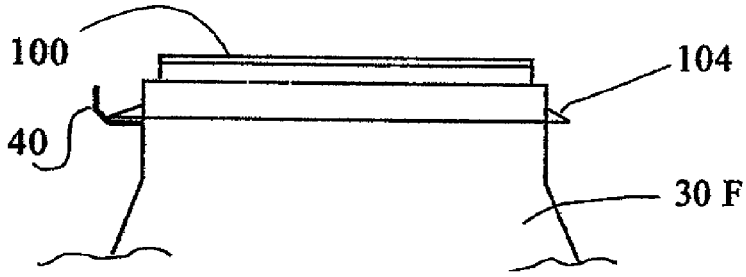
Figure 9G:
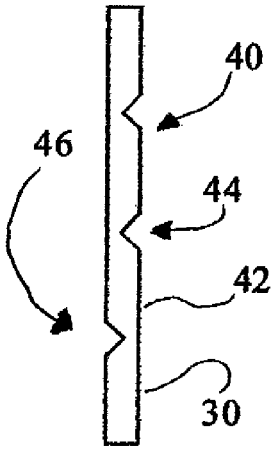
Figure 9H:
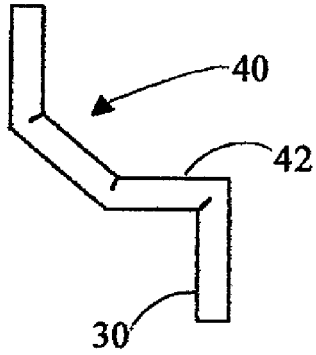

FIGS. 9E, 9G, and 9H depict an exemplary embodiment according to the invention.

Figure 9F:
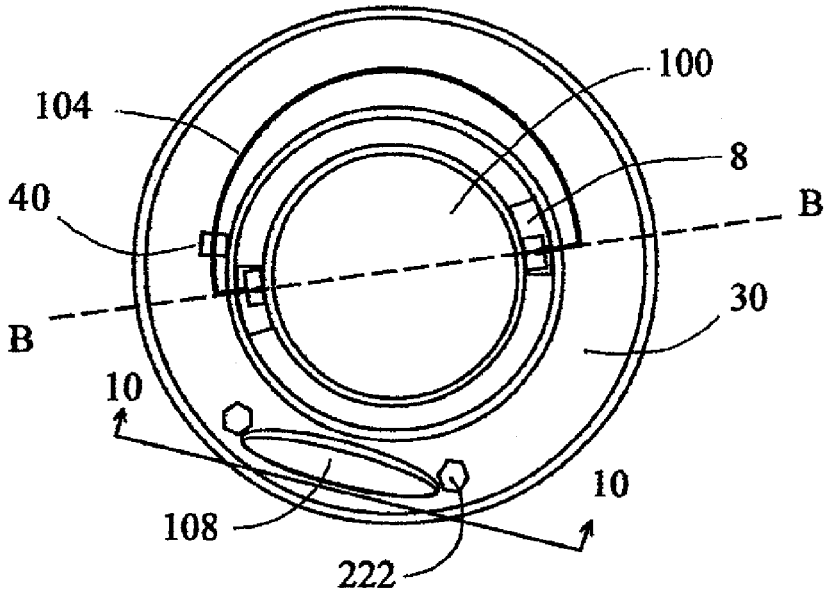

FIG. 9F illustrates a top view of an exemplary embodiment according to the invention with a container and a lid.

Figure 10:
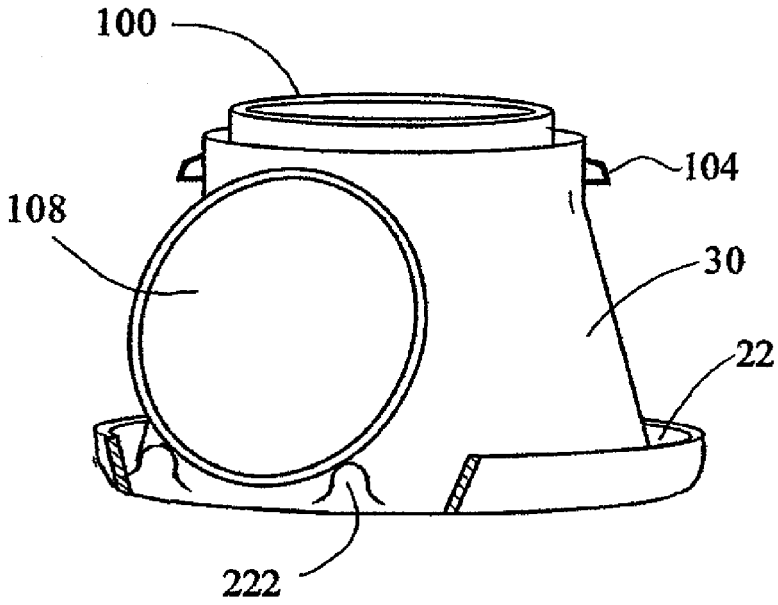

FIG. 10 depicts a partial cross-section of the exemplary embodiment shown in FIG. 9F taken at 10-10 in FIG. 9F.

Figure 11A:
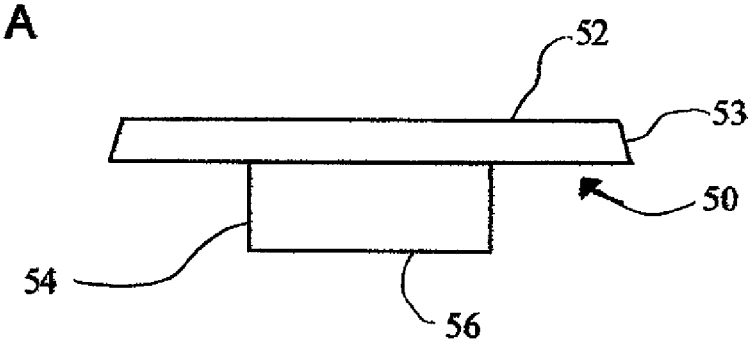
Figure 11B:
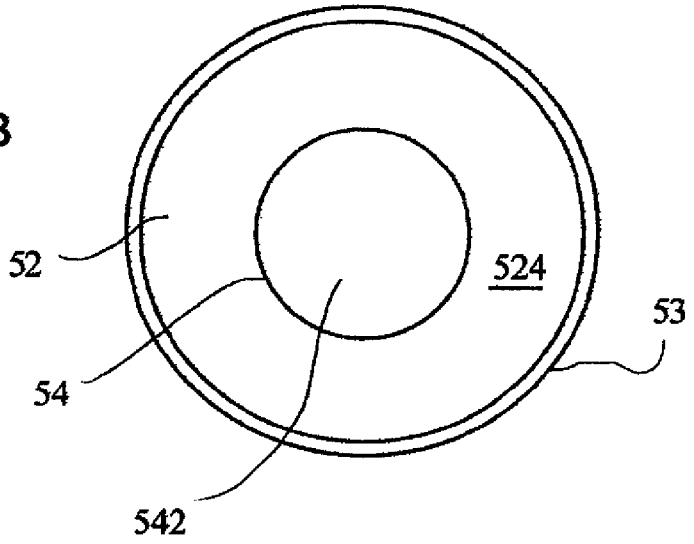
Figure 11C:
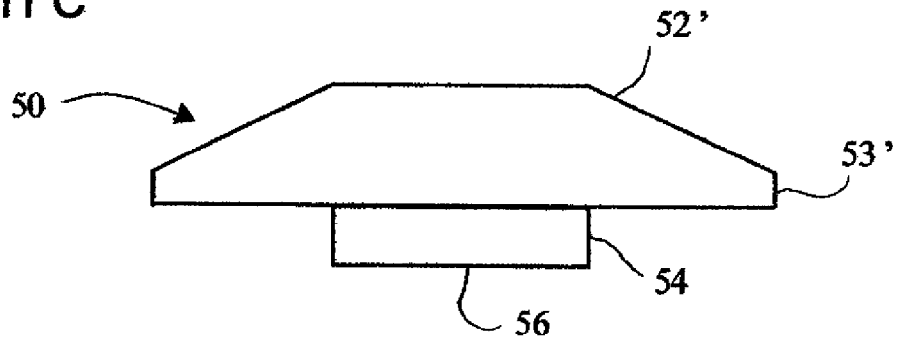

FIGS. 11A-11C illustrate exemplary inserts for use as part of the invention.

V. DETAILED DESCRIPTION OF THE INVENTION

Exemplary, non-limiting, embodiments of the present invention are discussed in detail below. While specific configurations and dimensions are discussed to provide a clear understanding, it should be understood that the disclosed dimensions and configurations are provided for illustration purposes only. A person of ordinary skill in the art will recognize that other dimensions and configurations may be used without departing from the spirit and scope of the invention.

The invention is a device for attaching to a liquid coating container that preferably includes a base and a wall having a means for engaging the container. The base preferably encircles the cavity into which the container is placed such that the wall includes a conical section between the base and the engaging means. The base rests against the ground/floor or other support surface. The engaging means in at least one exemplary embodiment includes an interface into which the ears of the container fit and engage the device, and as such the engaging means preferably is a collar structure which has a inner width at the interface larger than the diameter of the container although the inner diameter of the collar structure may be uniform to cause any spills from the container to run down the wall of the device, and into the base. In other exemplary embodiments, the engaging means includes a rim or a collar with an inner diameter sized to frictionally engage the outside of the container; and the engaging means may further include an O-ring or other sealant components to improve the engagement of the container. The diameter of the top of the wall preferably ranges from six and five-eighths inches to eight and three-quarters inches, and more preferably between six and five-eighths inches to seven and five-eighths inches for use with one gallon containers. These structures allow the weight of the container and the device to be distributed over a larger area than that of the container bottom thus providing stability to prevent the container from being tipped over when on a flat surface. The structure with a collar also allows the device to be placed on a ladder such that the collar contacts one step and the base is supported by the next lower step.

In at least one embodiment, when the device is placed on an inclined surface, the container is allowed to rotate about the container ears axis and remain substantially level, which decreases the possibility of spills from the container. This configuration also allows the liquid coating to drip down the sides of the containers, which is advantageous if the liquid coating is an adhesive or tar that would bond the container to the device. In at least one embodiment, the collar is sized to fit around the container such that any liquid coating that drips over the side will run down the wall to the base thus keeping the container label clean.

Figure 1A:
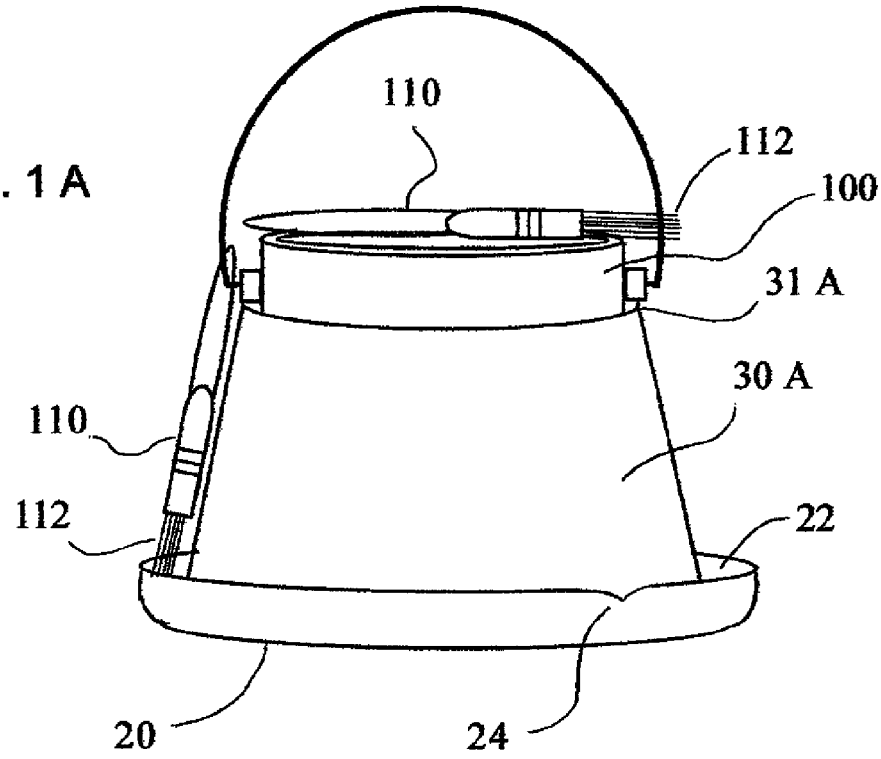
FIGS. 1A and 1B depict side views of exemplary embodiments according to the invention with a liquid coatings container inserted and brushes present in FIG. 1A.
Figure 1B:
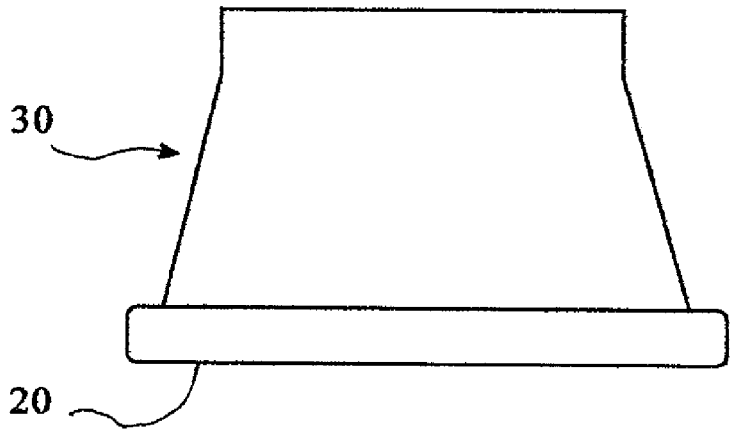
Figure 2:
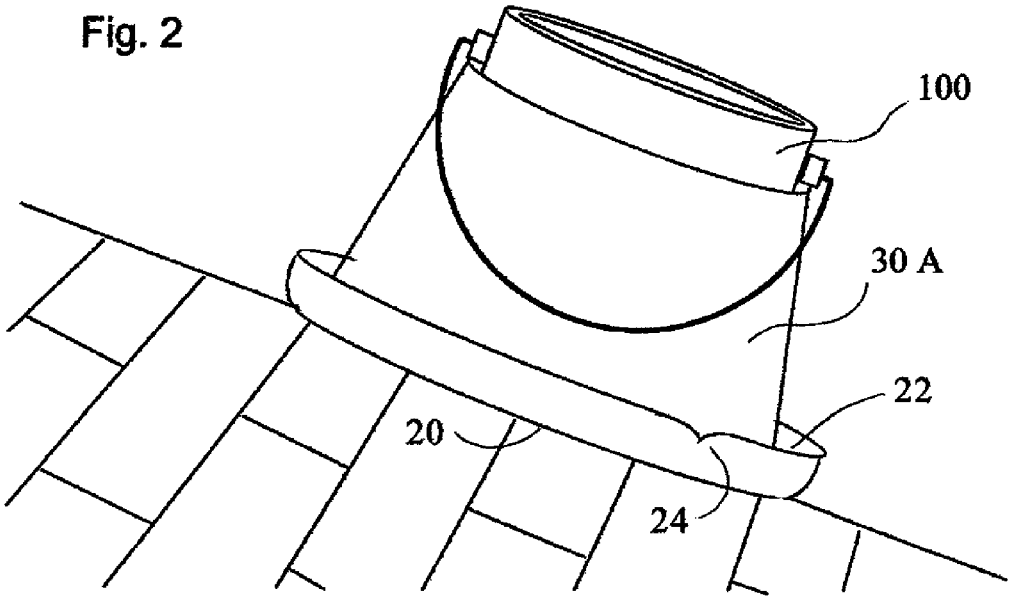
FIG. 2 illustrates a side view of the exemplary embodiment shown in FIG. 1A placed on an inclined surface.

FIGS. 1A and 2 illustrate an exemplary embodiment having a base 20 and a wall 30A extending up and in from the base 20 to a rim 31A. An exemplary ratio between the base 20 and the wall 30 is the base 20 having a diameter 1.5 times the height of the wall 30. The base 20 and the wall 30 form a cavity 36 into which the container 100 is placed with the base 20 forming a perimeter around the cavity 36. The base 20 as illustrated, for example, in FIG. 1A includes a trough 22 with a pour spout 24. The trough 22 may be omitted with the base 20 being, for example, a ring or a flat surface extending out from the wall 30 as illustrated in FIG. 1B, which also illustrates a wall 30 including a collar. The trough 22 may have a non-arcuate bottom as illustrated, for example, in FIG. 8B or a curved bottom as illustrated, for example, in FIG. 10. The wall 30A includes at least one section angled such that any liquid coating that spills, overflows, drips, etc. from the container 100 in the illustrated embodiment, for example, of FIGS. 1A-2 will flow down the wall 30A towards the trough 22 for collection in the trough 22, and as such the wall 30 is in fluid communication with the trough 22. This illustrated structure will largely keep the label of the container 100 free of the liquid coating. The trough 22 also will collect drips from brush bristles 112 (or other application tools) when the brush 110 is laid across the container 100 or placed tip down into the trough 22 to maintain wet bristles as illustrated in, for example, FIG. 1A. The illustrated wall 30A in FIGS. 1A and 2 includes a conical section running from the base 20 to a wall top 31A.

Figure 3:
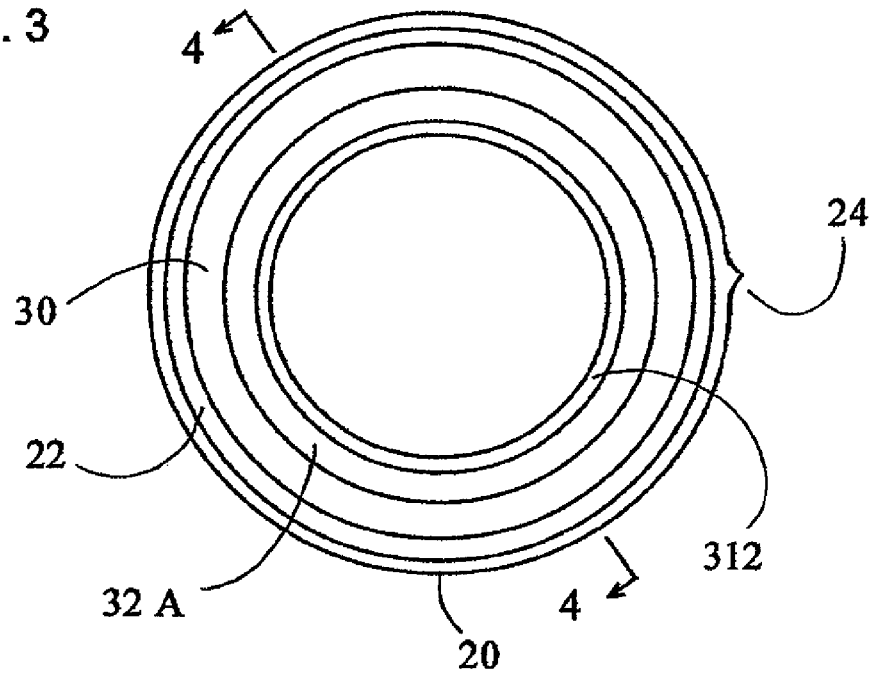
FIG. 3 depicts a top view of the exemplary embodiment shown in FIG. 1A.

The pour spout 24 then can be used to pour the collected liquid coating back into the container 100 once removed from the device or into a disposal location. Although a pour spout 24 is illustrated, it can be omitted in alternative embodiments as illustrated in, for example, FIG. 6. The wall top (or rim) 31A is an example of the means for engaging the container, and as mentioned above and illustrated in FIG. 3 may include an O-ring (or other sealing structure) 312.

Figure 4A:
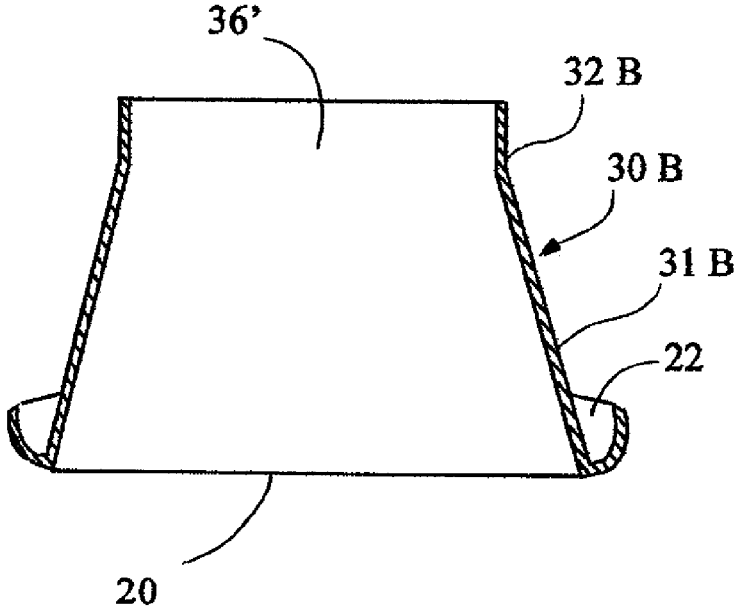
FIGS. 4A-4C illustrate exemplary cross-sections taken at 4-4 in FIG. 3 with FIG. 4C illustrating additional features.
Figure 4B:
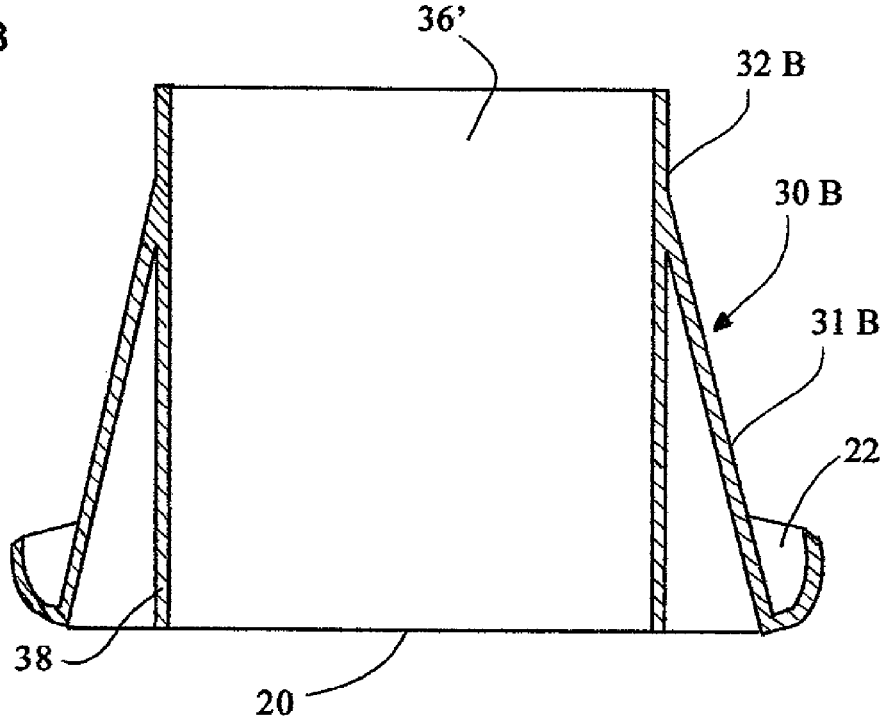

FIG. 4A illustrates the device as having an external structure with an open inner cavity 36. This arrangement provides a lightweight and stackable device. In contrast, FIG. 4B illustrates the device as having an inner wall 38 whose diameter is sized to fit around or slightly larger than the diameter of the container 100 with the area bounded by the inner wall 38 being an open cavity 36'. The presence of inner wall 38 improves the connection between the device and the container 100, in part because of the additional area in frictional engagement with the container 100. Additionally, because of the additional frictional area, there will be decrease odds of the liquid coating flowing down the container side. One of ordinary skill in the art will realize that the area between the inner wall 38 and the wall 30 may be filled with material, an enclosed cavity, or open as illustrated in FIG. 4B. Although the inner wall 38 is illustrated with an exemplary embodiment having a cylindrical section 32 of the wall 30, one of ordinary skill in the art will appreciate based on this disclosure that the inner wall 38 may be used in conjunction with the other container engaging means.

Figure 4C:
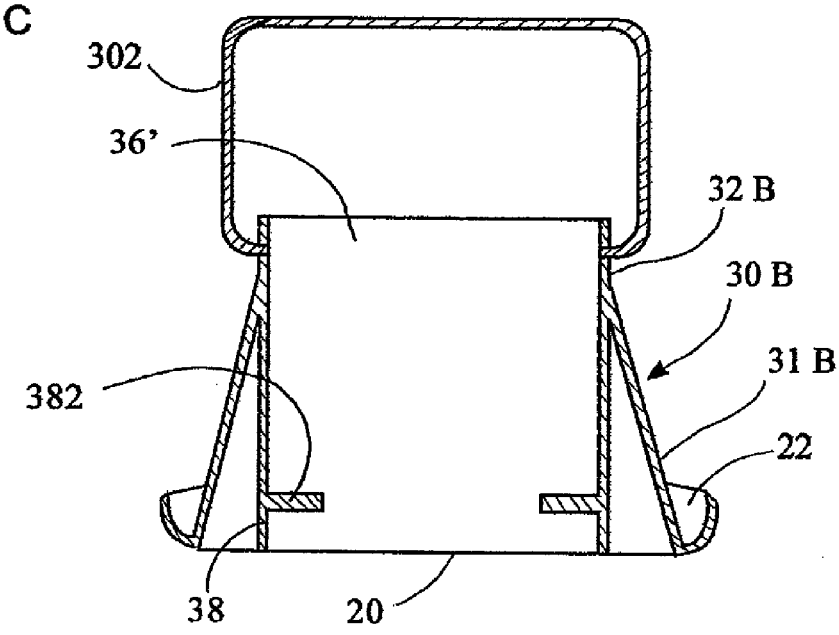

FIG. 4C illustrates the inner wall 38 with a rim 382 or floor (means for supporting the container) extending inward to provide support for the container 100. This embodiment is advantageous for when the container 100 does not have ears or a handle to rest against the top of the collar 32B. This illustrated embodiment also includes a handle 302 for use in transporting the device with or without a container 100 inserted into cavity 36'. FIG. 4C also illustrates an embodiment that spaces the container 100 from the surface on which the device is placed.

FIGS. 4A-4C also illustrate an exemplary embodiment that includes a wall 30B having a conical section 31B and a cylindrical section (or collar) 32B. The collar 32B is an example of the container engaging means. The collar 32B preferably has an inner diameter sized to fit around or slightly larger than that of the container 100 to provide a frictional engagement between the device and the container 100.

Figure 5C:
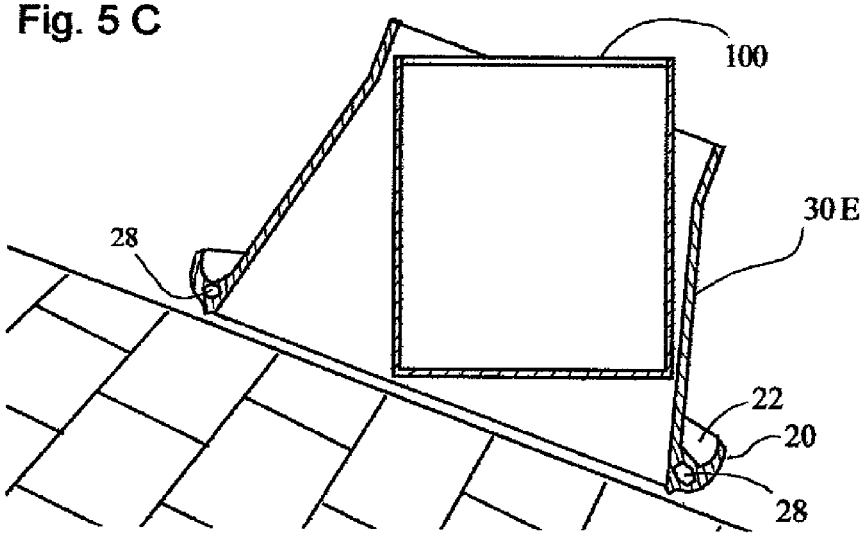
FIG. 5C depicts an exemplary embodiment cross-section according to the invention.
Figure 5A:
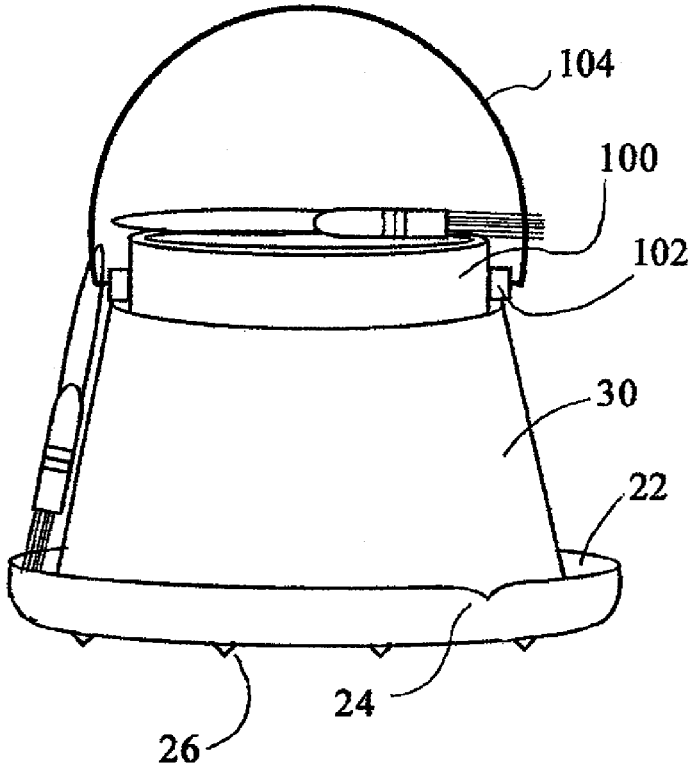
FIGS. 5A and 5B depict an exemplary embodiment according to the invention with protrusions extending from the base.
Figure 5B:
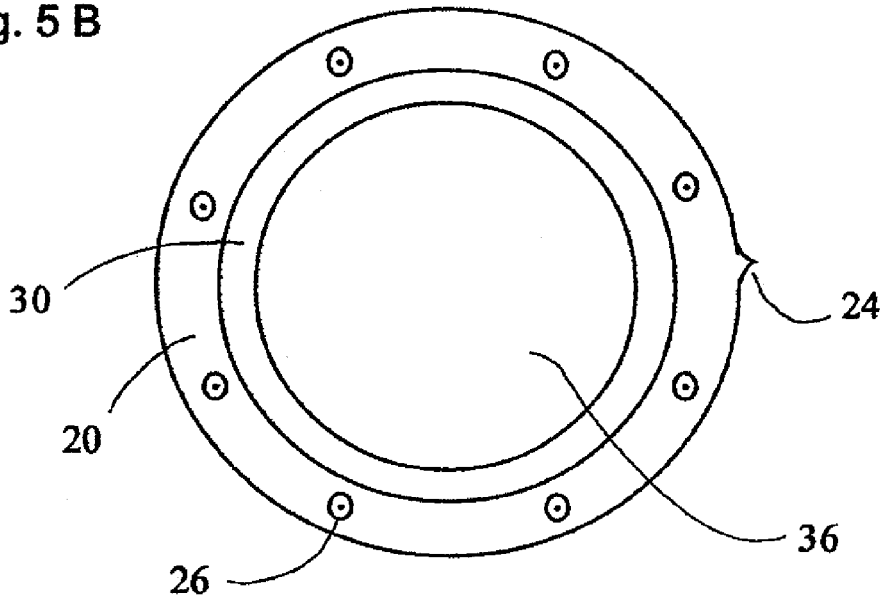

FIGS. 5A (with container 100) and 5B (without container 100) illustrate an exemplary embodiment with protrusions 26 extending from the bottom of the base 20 to provide additional resistance to sliding of the device along the surface that it is placed on. Examples of protrusions 26 include the illustrated cleats, bumps, ridges, footings, and a patterned surface. The protrusions, for example, may be made of a thermoplastic resin such as polyethylene or polypropylene, metal, or rubber. The weight of the container 100 and its contents will further provide a downward force to resist movement of the device relative to the surface where it is placed. The cleats are particularly useful on a slanted roof to prevent the device from sliding off of the roof. Another embodiment has the base 20 having a weighted secondary material impregnated into the primary material used to construct the base 20. An example of the secondary material includes sand being present in the primary material used to form the base 20. Another possibility is a compartment 28 that runs along the bottom of the trough or provides the bottom surface for the base that includes deadweight such as sand or a liquid as illustrated in FIG. 5C. The compartment 28 can be premolded into the base 20.

Figure 6:
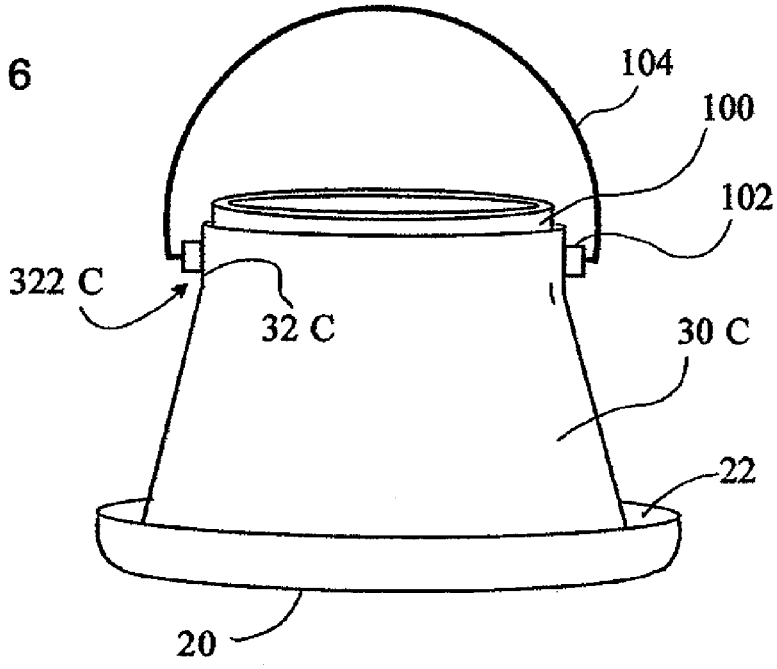
FIG. 6 depicts a side view of an exemplary embodiment according to the invention.
Figure 7:
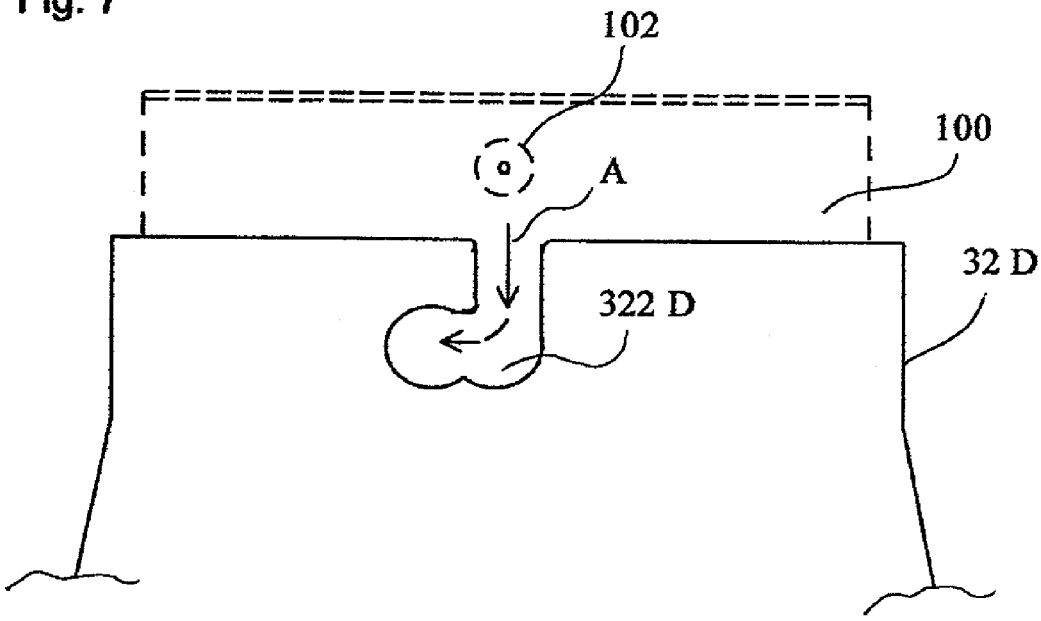
FIG. 7 illustrates a second side view of the exemplary embodiment shown in FIG. 6.

FIG. 6 illustrates an exemplary embodiment of the device where the collar 32C includes a pair of slots (or other openings) 322C to engage the ears 102 of the container 100. The slots 322C are an example of the container engagement means. FIG. 7 illustrates an exemplary slot 322D that includes a reverse "L" (or "J") shape slot that allows the ears 102 to slide in to the slot 322. Each of the ears 102 engages the end of the slot 322D and occupies the slot 322D to allow the device to be carried along with the container 100 by the handle 104. Otherwise, the ears 102 can rest on the bottom of the slot 322D. The arrows A show how the ears 102 slide in and engage the slots 322D.

As illustrated in FIG. 7, the container can then be turned clockwise, therefore causing the container ears 102 to travel into the hooked end of the slots 32D. When the container 100 is lifted by its handle 104 (not shown in FIG. 7), the device is now simultaneously lifted along with the container 100.

Figure 8A:
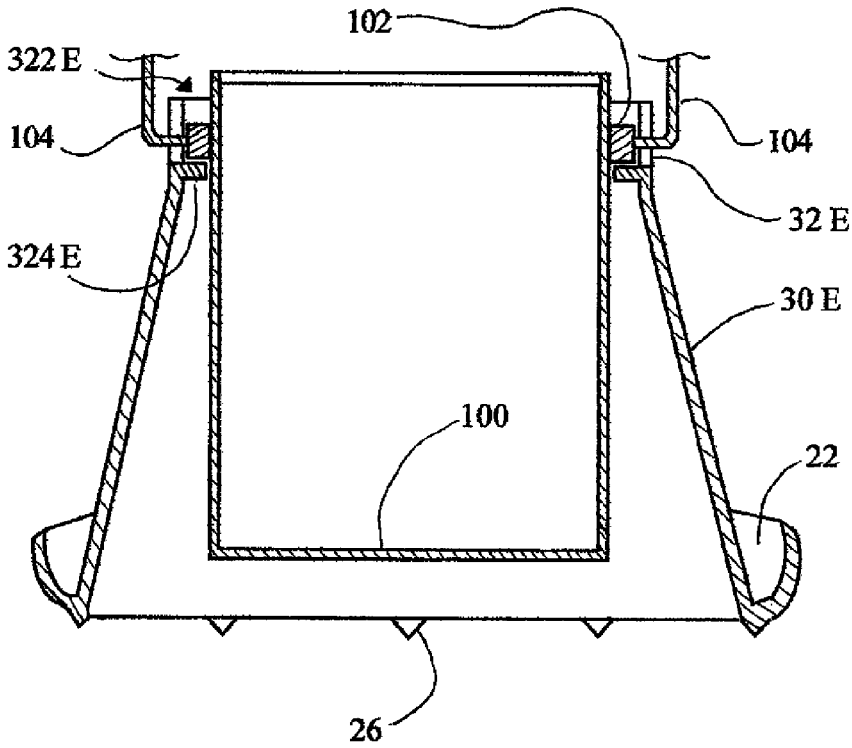
FIG. 8A depicts a cross-section of an exemplary embodiment according to the invention with a container placed within the exemplary embodiment.

FIG. 8A illustrates a cross-section view of an exemplary embodiment of the device where the collar 32E includes at least one shelf 324E. The shelf 324E may be two separate shelves each located proximate a respective slot 322E or a rim that lines the inside of the collar 32E at a point below the slots 322E. The shelf 324E provides additional support to the container 100 and allows the container 100 to remain level even on an inclined surface as illustrated, for example, in FIGS. 8B and 8C. When the shelf 324E is present on the interior of the collar 32E, then the liquid coating that is spilled can run on the outside of the container 100 to lessen the likelihood of the container 100 from becoming attached to the device. The presence of the shelf 324 allows the top opening of the device to be circular as illustrated, for example, in FIG. 9F while still allowing the container 100 to rotate about the ears axis B-B. A circular top opening is typically more aesthetically pleasing to the eye when used in conjunction with a cylindrical container. The circular top opening also eases production of the device by having a horizontal, circular cross-section from the top to the bottom, although it is possible to have a circular base 20 with an elliptical opening at the top of wall 30. One of ordinary skill in the art will appreciate based on this disclosure that the shelf 324E could be located on the outside wall of the collar 32 while still providing some contact between the collar 31 and the container 100 such that at least some spilled liquid coating can run down the wall 30 into trough 22.

FIG. 9A illustrates another exemplary embodiment of the slots 322F where the bottom surface includes channels (or grooves) 3222F for abutting the inserted ears 102. The channels 3222F may be incorporated into a ledge 324F or be present just across the width of the collar 32F. The shelf (or rim) 324 and ledge 324F are examples of a means for supporting the ears.

FIGS. 9A-9F also illustrate an exemplary handle rest 40 that includes a member having a plurality of segments 42 with notches 44 present between each pair of segments 42 to allow the handle rest 40 to be positioned away from the wall 30 and provide a support for the handle 104. FIG. 9B illustrates the handle rest 40 in its stored position, while FIG. 9C illustrates the handle rest 40 positioned for the handle 104 to rest on it. Resting the handle 104 away from the wall 30 (i.e., not having the handle 104 resting against the wall 30) prevents the handle 104 from being covered by the liquid coating and adhering to the device when the liquid coating dries. Also, typically when the handle 104 becomes covered with the liquid coating, the user's hands get covered with any wet liquid coating present on the handle 104 when using the handle.

Another exemplary embodiment for the handle rest 40 is shown in FIGS. 9E, 9G and 9H where the handle rest 40 provides a cradle area for the handle 104 to rest. The handle rest 40 includes a notch 46 between the bottom segment 42 and the wall 30 to provide a hooked interface for the handle 104. FIG. 9G illustrates the handle rest 40 in its stored position, while FIG. 9H illustrates the handle rest 40 positioned for the handle 104 to rest on it. Although three segments 42 are illustrated in these two handle rest 40 examples, other numbers of segments 42 may be used and still provide the same function of keeping the handle 104 away from the wall 30. Although one handle rest 40 is illustrated in these figures, a plurality of handle rests 40 may be present around the outside of the wall.

Figure 8B:
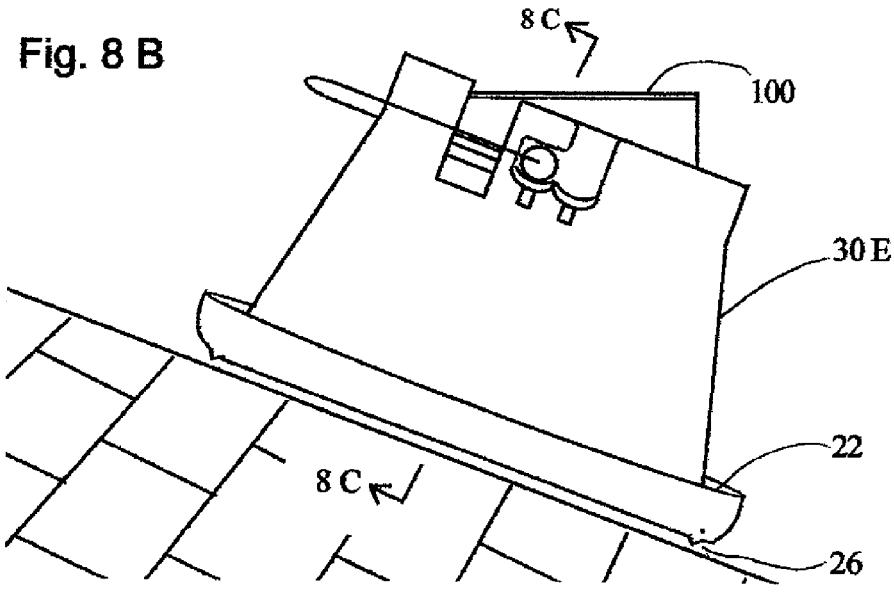
FIG. 8B illustrates a side view of the exemplary embodiment shown in FIG. 8A placed on an inclined surface with a container in place.
Figure 8C:
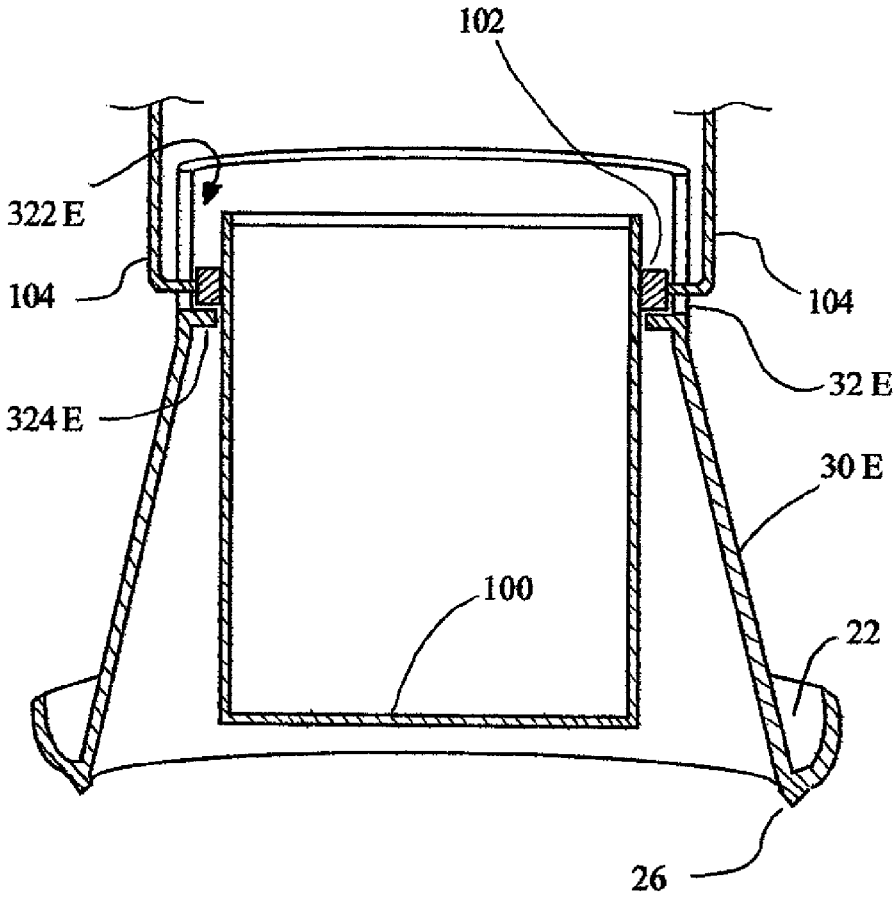
FIG. 8C depicts a cross-section of the exemplary embodiment shown in FIG. 8B taken at 8C-8C through the ears of the container.

When the container engaging means across its top surface is either oval shaped with a width sized to fit around the container 100 or circular shaped in the slot or ledge exemplary embodiments above, the container 100 is able to rotate about the container ears axis B-B to allow the container 100 to get to a naturally level plane when the device is placed on a sloped surface as illustrated, for example, in FIGS. 8B and 8C—which will decrease the possibility of spills from the container 100 when it is substantially full and also during transport to counteract any swinging motion of the combination. The height of the wall and the angle of the inclined wall section 31 in these embodiments allow the container 100 to rotate through a greater range than without the inclined wall section 31. A larger base footprint will better distribute the weight and thus manage the change in the center of gravity that results from the container 100 hanging in a plane that is not parallel to the base 20.

The container engaging means described above also in at least one embodiment raises the container 100 off of the surface by having the wall 30 have a height that is greater than the distance from the bottom of the container 100 to the guides 102 as illustrated in, for example, FIG. 8A. An exemplary height for wall 30 is at least eight inches, and in at least one exemplary embodiment is approximately nine inches. An exemplary distance by which the container may be raised falls within a range of 0.25 inches to 2 inches.

FIGS. 9F and 10 illustrate an exemplary embodiment of the device with two raised protrusions 222 for preventing a stored lid 108 from rolling about the trough 22 during normal use including transport of the combination of the container 100 and the device. This embodiment more easily allows the lid 108 to remain with the container 100 from which it came while keeping the lid 108 from rolling about the trough 22 into a stored paint brush (or other application tool). This arrangement allows the lid 108 to face the wall 30 to minimize dirt and other airborne material adhesion even if the protrusions 222 are omitted.

The device according to the invention may be made, for example, from polypropylene, polyvinyl chloride, silicones, thermoplastics, plastics, rigid polymers or metal.

The invention may also include an attachment (or insert) 50 to utilize different sized liquid coating containers within the device as illustrated in FIGS. 11A and 11B. The attachment 50 as illustrated includes a cover 52 having a sufficient radius to have an outside rim 53 fit securely over the top of the rim 31 or collar 32. Although the rim 53 is shown as slanted in FIG. 11A, the rim 53 could have a vertical wall to better engage the device when a collar 32 is present as illustrated in FIG. 11C. The illustrated attachment includes a cylindrical chamber (or cavity) 542 formed by a cylindrical wall 54 depending from an opening passing through the cover 52. The chamber 542 is sized to fit a particular size container such as a quart container or a pint container with a floor 56 of the chamber 542 providing support. The cylindrical wall 54 provides frictional engagement of the inserted container and prevents the container from sliding around within the attachment 50. Although a floor 56 is illustrated in FIG. 11B, a ledge or rim extending in from the bottom of the cylindrical wall 54 could replace the illustrated floor 56 as such these all can be considered to be means for supporting a container. The cover 52 as illustrated in FIG. 11A is a flat surface; however, the cover 52' may be slanted such that the liquid coating runs from the container across the cover 52' and then down the wall 30 thus protecting the label of the container as illustrated in FIG. 11C. A modification to this alternative embodiment is to have the attachment be a solid piece and thus not having a cavity existing around the bottom of the attachment 50.

The invention may alternatively be scaled such that after manufacture it can fit a particular sized liquid coatings container and the like. Preferably, the invention would be scaled for a one-gallon liquid coatings container, but also could be built to fit liquid coatings containers smaller and larger such as pint size, quart size, and 5 gallon size and liquid coating containers with and without ears.

The exemplary and alternative embodiments described above may be combined in a variety of ways with each other.

As used above "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

Although the present invention has been described in terms of particular embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the embodiments described above can be configured without departing from the scope and spirit of the invention. Therefore, it is to be understood that, within the scope of the appended claims, the invention may be practiced other than as specifically described herein.

I claim:

1. A device for holding and supporting a container having a handle and a pair of ears, the device comprising:

a base having a centrally disposed opening passing therethrough larger than the container to be inserted;

a wall extending up and in from said base, said wall including an angled section connected to said base, and a container engaging means for engaging the container, wherein said wall and said container engaging means allow the container to pivot and remain level when the device is placed on non-horizontal surfaces, said container engaging means includes a collar having a pair of slots running from the top of the collar down, said collar connected to said angled section;

at least one shelf connected to said collar, wherein a diameter of said collar is greater than the diameter of the container to be inserted; and said at least one shelf provides a cavity with a diameter proximate to the diameter of the container to be inserted such that the ears of the container to be inserted are able to rest on said at least one shelf and pivot about an axis of the ears.

2. The device according to claim 1, wherein said container engaging means includes a rim at the top of said angled section.

3. The device according to claim 1, wherein said angled section of said wall is taller than said collar.

4. The device according to claim 1, wherein said container engaging means includes a means for supporting the ears of the container.

5. The device according to claim 1, wherein said base includes a ring.

6. The device according to claim 1, wherein said base includes a trough in fluid communication with said angled section of said wall.

7. The device according to claim 1, wherein said wall has a height of at least 8 inches.

8. The device according to claim 1, wherein said base has a bottom surface, and said base includes a plurality of protrusions extending from said bottom surface.

9. The device according to claim 1, wherein said wall extends up and in from an interior diameter of said base.

10. The device according to claim 1, wherein said base has a diameter 1.5 times a height of said wall.

11. A device for holding and supporting a container on a support surface, the device comprising:

a base capable of sitting on the support surface, said base including a trough; and a wall extending up and inward from said base, said wall including an angled section connected to and in fluid communication with said trough, and a vertical section connected to said angled section, said vertical section capable of contacting the container; and said base and said wall form a cavity configured to receive the container, and said trough forming a perimeter around the cavity; and wherein said angled section is taller than said vertical section.

12. The device according to claim 11, wherein said vertical section includes a pair of "L" shaped slots running from a top of the vertical section.

13. The device according to claim 12, further comprising a ledge proximate to the slots and extending in from an inside surface of said vertical section.

14. The device according to claim 11, wherein said base has a diameter 1.5 times a height of said wall.

15. The device according to claim 11, wherein said wall having sufficient height to raise an inserted container between 0.25 inches to 2 inches from the support surface.

16. A device for supporting and holding a container having a pair of ears connected by a handle, said device comprising:

a base having a trough and at least two protrusions connected to said trough, and a wall extending up and in from said base, said wall including an angled section connected to and in fluid communication with said trough, a vertical section connected to said angled section, said vertical section including a pair of slots configured to engage the ears of the container, at least one shelf extending from an inside of said vertical section at a location below said slots, at least one handle mount having a plurality of sections with a notch present between each of said sections; and said base and said wall form a cavity configured to receive the container, and said trough forming a perimeter around the cavity.

17. The device according to claim 16, wherein said angled section is taller than said vertical section.

* * * * *